US005099540A

United States Patent [19]

Paschetto

[11] Patent Number: 5,099,540

[45] Date of Patent: Mar. 31, 1992

[54] ICE SCRAPER

[76] Inventor: Paul E. Paschetto, 136 Melwood Ave., East Longmeadow, Mass. 01028

[21] Appl. No.: 599,086

[22] Filed: Oct. 17, 1990

[51] Int. Cl.[5] ..... A47L 1/06

[52] U.S. Cl. ..... 15/236.02; 15/236.01; 15/236.05

[58] Field of Search ..... 15/236.02, 236.05, 236.01

[56] References Cited

U.S. PATENT DOCUMENTS

| | | | |
|---|---|---|---|
| D. 34,272 | 3/1901 | Hoffman . | |
| 2,277,528 | 3/1942 | Osborn | 15/105 X |
| 2,556,691 | 6/1951 | Harshbarger . | |
| 3,408,677 | 11/1968 | Yates . | |
| 4,495,670 | 1/1985 | Baker . | |
| 4,813,458 | 3/1989 | Jacobucci | 15/236.02 |
| 4,922,569 | 5/1990 | Brinker et al. | 15/236.02 X |
| 4,970,749 | 11/1990 | Priore | 15/245 X |

FOREIGN PATENT DOCUMENTS

| | | | |
|---|---|---|---|
| 2436697 | 5/1980 | France | 15/105 |

*Primary Examiner*—Chris K. Moore
*Attorney, Agent, or Firm*—Donald Holland

[57] ABSTRACT

An ice scraper is disclosed with multiple scraping surfaces. In the preferred embodiment, the scraper comprises a polygonal plastic plate with a central circular opening that acts as a handle; and a plurality of straight sides that form an octagon, wherein each of the sides has multiple sharp edges for scraping. This plurality of edges provides many working surfaces. Consequently, when one edge becomes dull, the invention need not be thrown away. Instead, it can be rotated, or flipped over, to use a new edge. In addition, because of the plurality of working edges, the user may scrape in a variety of directions without repositioning himself or realigning the scraper.

11 Claims, 2 Drawing Sheets

ICE SCRAPER

BACKGROUND OF THE INVENTION

The present invention relates to scraping devices, and more particularly, it relates to devices used to dislodge ice from car windows.

As anyone who has lived in cold weather climates knows, winters can be filled with days of ice and snow. These days typically involve early mornings which will force a traveler to go to great lengths to remove ice and snow from his car windows so that he may be able to see clearly while driving.

Not only is the driver burdened by the extra time he must expend to accomplish his task, he is also hampered by the less-than-ideal design of the actual window scraper. Conventional window scrapers force the user to scrape in a unidirectional manner. If a user desires to scrape in a vertical fashion, rather than a horizontal direction, he is forced to reposition himself and the scraper. Consequently, conventional scrapers are awkward and impractical.

Most scrapers also have a single scraping edge. When that edge becomes worn, the scraper should be thrown away. Otherwise, a user has to wait for his car heater to warm up and soften the ice, before it can be cracked off.

Accordingly, it is a general object of the present invention to greatly increase the effectiveness of scrapers by overcoming the conventional hurdle of unidirectional scrapers.

It is another general object to provide an improved scraping device that will allow the user to conveniently and effectively remove ice from flat surfaces, especially motor vehicle windows.

It is a more specific object to provide a plate-like polygonal scraper with multiple sides, which can be easily grasped and rotated to use any selected side (or its edges) for scraping.

It is yet another object to provide a lightweight scraper that is economical in design, yet extremely safe and durable to use.

The above and other objects and advantages of this invention will become more readily apparent when the following description is read in conjunction with the accompanying drawings.

DETAILED DESCRIPTION OF THE PREFERRED EMBODIMENTS

Figure 1:
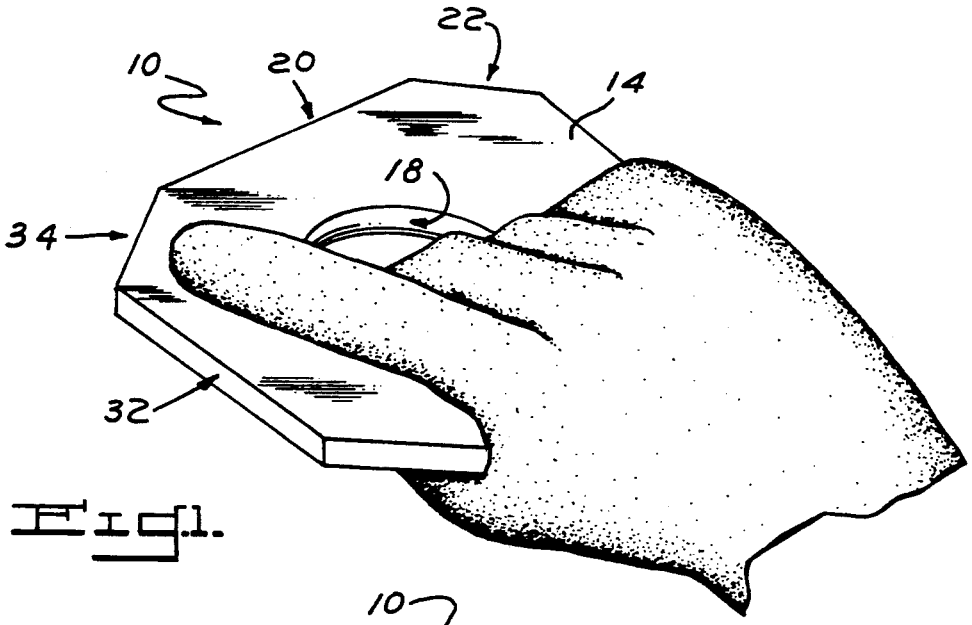
FIG. 1 shows a scraper constructed in accordance with the present invention. It is being grasped by a user's gloved hand.
Figure 2:
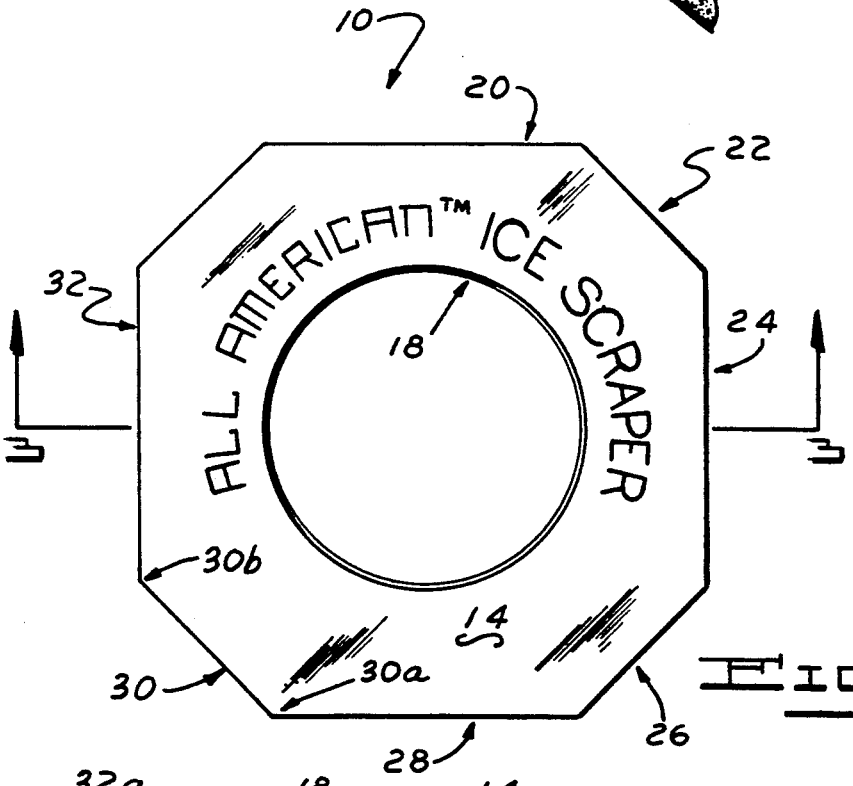
FIG. 2 is a top plan view of the scraper, with identifying indicia previously omitted from FIG. 1.
Figure 3:
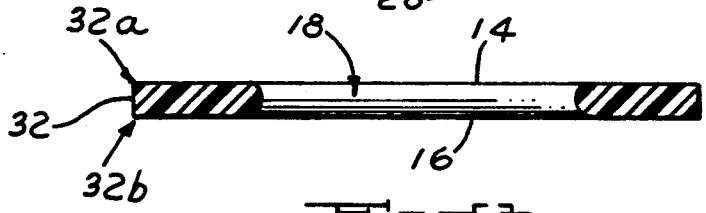
FIG. 3 is a cross-sectional view taken along line 3—3 of FIG. 2.

Referring to the drawings in detail, a novel ice scraper is shown in FIGS. 1–3 and generally designated by the reference numeral 10. It is presently being marketed under the trademark, ALL AMERICAN TM ICE SCRAPER, by Easy Scraper Marketing of East Longmeadow, Mass.

In the preferred embodiment, the scraper 10 is a plastic polygonal plate 12 having a top 14 and bottom 16. The plate 12 has a central circular opening 18 and eight perpendicular, flat sides or scraping surfaces 20, 22, 24, 26, 28, 30, 32, 34 which are arranged in the shape of an octagon. Each side has crisp, squared shoulders with horizontal edges, where it meets the plate's top 14 and bottom 16. (For example, see the shoulders of side 32 at **32*a* and 32*b* in FIG. 3**.)

Four of the sides (20, 24, 28, 32) are slightly longer than the remaining sides (22, 26, 30, 34) interspersed between them. There are crisp, sharp vertical edges where each short side meets a longer one (e.g., **30*a*, 30*b***).

The illustrated scraper can be made from any strong, acrylic plastic which does not leave abrasion marks on the window. Presently, it is injection molded and then machined to provide crisp edges.

In operation, the large center opening 18 allows the user to comfortably and firmly grip the scraper, even if he is wearing thick gloves or mittens (see FIG. 1). The user may grasp the scraper from any side 20, 22, 24, 26, 28, 30, 32, 34. This is unlike conventional scrapers where the placement of the handle dictates the one and only position from which the scraper may be effectively used. Also, because the area between the center 18 and any side 20, 22, 24, 26, 28, 30, 32, 34 is small, this allows the user to obtain a firm grip on the scraper.

Once the user grips the scraper 10, he may scrape in a variety of directions without repositioning himself or scraper 10. This is because of the multiple sides, which allow such scraping to be done in an easy and efficient manner.

The scraper's shorter sides 22, 26, 30, 34 (along with their horizontal and vertical edges) serve two additional purposes. First, they allow the user to scrape any sized area, especially small areas, without employing a multitude of various-sized scrapers. For instance, the user may scrape the front windshield as well as the side-view mirror with the same scraper. Second, the smaller-sized sides (and their edges) allow the user to break up heavy concentrations of frozen material with forceful blows or chops.

The scraper, in its preferred embodiment, has a longer useful life than prior scrapers because of its eight usable sides 20, 22, 24, 26, 28, 30, 32, 34. Should a particular side edge become dull due to wear, the user can simply rotate the unique scraper 10, or flip it over, and utilize a different and sharper edge. This cannot be done with most prior scrapers, since they have only one working edge. When it becomes worn, the entire scraper becomes ineffective and should be discarded.

The present invention has several other practical benefits. For example, not only does the circular opening 18 act as a "handle", it also serves as a peghole for quick and simple storage of the device during warm seasons. Also, because the scraper is a compact plate, it will fit neatly into any glovebox or under any car seat.

Figure 4:
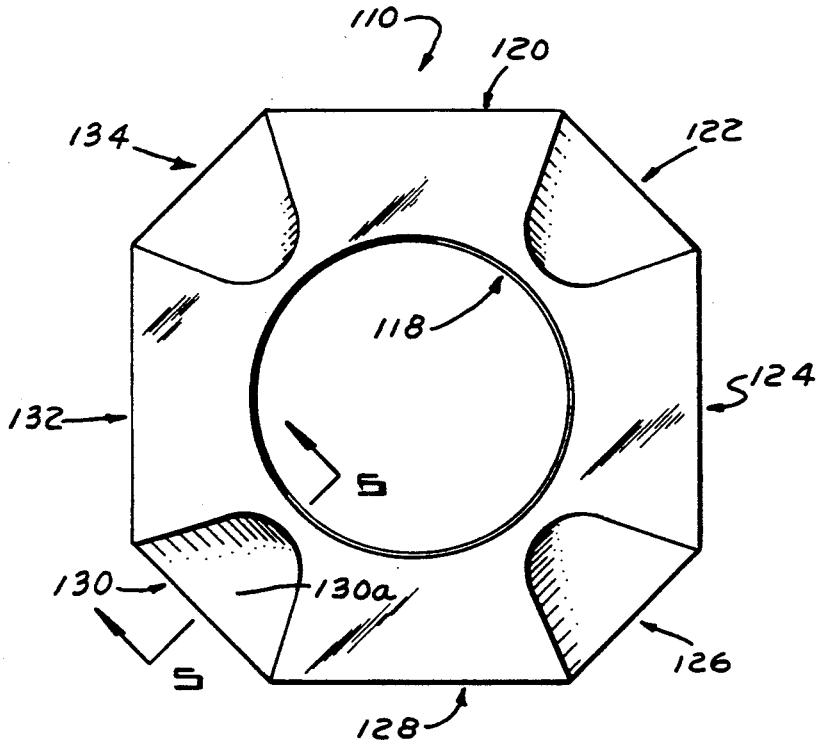
FIG. 4 is a top plan view of an alternate embodiment.
Figure 5:
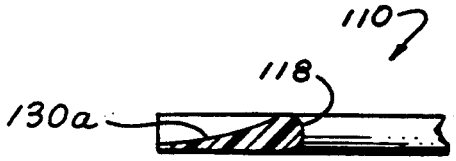
FIG. 5 is a fragmentary cross-sectional view taken along line 5—5 of FIG. 4.

FIGS. 4–5 show an alternate embodiment of the invention, generally designated as 110. Like scraper 10 (shown in FIGS. 1–3), this embodiment is octagonal with a central opening 118; plus four long sides 120, 124, 128, 132 and four short sides 122, 126, 130, 134. It differs from scraper 10 only in the configuration of its short sides.

In scraper 10, the top and bottom surfaces 14, 16 are continuously flat and horizontal. They lie in single planes. Here, however, there are sloped concave section or conical "notches" in the short sides—to act as chisels to assist in scraping. As best shown in FIG. 5, the top surface of each short side (e.g., 130*a*) is notched, with its deepest point occurring at the scraper's periphery. From there, the notch gradually shrinks toward central opening 118, until it ends.

It should be understood by those skilled in the art that obvious structural modifications can be made without departing from the spirit or scope of the invention. For example, other polygons could be used; or concave side surfaces could be used for a chisel effect during scraping. Accordingly, reference should be made primarily to the accompanying claims, rather than the foregoing specifications, to determine the scope of the invention.

Having thus described the invention, what is claimed is:

1. An ice scraper comprising:

a. a flat plastic octagonal plate having a top and bottom;

b. said plate having a plurality of straight, flat sides with multiple scraping edges where the flat sides meet the plate's top and bottom, wherein the flat sides are substantially perpendicular to the plate's top and bottom to provide crisp horizontal edges for scraping, and wherein the sides have vertically extending edges, between contiguous sides, that also act as scraping edges;

c. wherein the plate also has a circular central opening that is adapted in size, along with the rest of the plate, to act as a handle for a user to grasp the scraper; and d. whereby the scraper can be rotated and flipped over to selectively use any of its multiple edges, while being grasped, to remove ice or snow from a vehicle.

2. The scraper of claim 1 wherein some of the sides are shorter than others, with the shorter sides being interspersed between longer ones.

3. The scraper of claim 1 wherein the shorter sides are adapted in size to scrape ice from a car's side mirror.

4. The scraper of claim 1 wherein the shorter sides include notches that extend radially inwardly from the periphery of the scraper, and slope upwardly toward the central opening, to act as chisels to assist in scraping.

5. An ice scraper comprising:

a. a flat plastic octagonal plate having a top and bottom;

b. said plate having a plurality of straight, flat sides with multiple scraping edges where the flat sides meet the plate's top and bottom, wherein the flat sides are substantially squared with the plate's top and bottom to provide crisp horizontal edges for scraping, and wherein the sides have vertically extending edges, between contiguous sides, that also act as scraping edges;

c. wherein the plate also has a central opening that is adapted in size and shape, along with the rest of the plate, to act as a handle for a user to grasp the scraper; and d. whereby the opening permits the scraper to be rotated, or flipped over, so that any of its multiple edges can be used to scrape away ice.

6. The scraper of claim 5 wherein some of the sides are shorter than others, with the shorter sides being interspersed between longer ones.

7. The scraper of claim 6 wherein the shorter sides include notches that extend radially inwardly from the periphery of the scraper, and slope upwardly toward the opening, to act as chisels to assist in scraping.

8. An ice scraper comprising:

a. an acrylic plastic flat plate having a substantially flat top and bottom;

b. said plate having a plurality of flat sides which are arranged to substantially form a polygon, wherein each side has multiple edges for scraping that include two horizontal edges where said side meets the plate's top and bottom and vertical edges where said side meets contiguous sides;

c. said plate also having a circular central opening that is adapted in size and shape, along with the rest of the plate, to act as a sturdy handle that allows a user to grasp the scraper; and d. wherein the scraper can be rotated and flipped over, and then grasped, to selectively use any of its multiple side edges as a scraping surface to remove ice or snow from a vehicle.

9. The scraper of claim 8 wherein some of the sides are shorter than others, with the shorter sides being interspersed between longer ones.

10. The scraper of claim 9 wherein the shorter sides include notches that extend radially inwardly from the periphery of the scraper, and slope upwardly toward the opening, to act as chisels to assist in scraping.

11. An ice scraper comprising:

a. a flat plastic octagonal plate with a substantially flat top and bottom;

b. said plate having a plurality of straight, flat sides with multiple scraping edges, wherein:

i. the flat sides are substantially squared with the plate's top and bottom to provide crisp horizontal edges for scraping;

ii. the sides have vertically extending edges between contiguous sides, that also act as scraping edges;

iii. some of the sides are shorter than others, with the shorter sides being interspersed between longer ones; and iv. the shorter sides include notches that extend radially inwardly from the periphery of the scraper, and slope upwardly toward the opening, to act as chisels to assist in scraping;

c. wherein the plate also has a circular central opening that is adapted in size and shape, along with the rest of the plate, to act as a sturdy handle for a user to grasp the scraper;

d. whereby the opening permits the scraper to be rotated, or flipped over, so that any of its multiple edges can be used to scrape away ice.

* * * * *